United States Patent [19]

Kuus et al.

[11] 4,101,796

[45] Jul. 18, 1978

[54] HIGH-PRESSURE DISCHARGE LAMP

[75] Inventors: Gijsbert Kuus; Peter Andreas, Waltherus Tielemans, both of Eindhoven, Netherlands

[73] Assignee: U.S. Philips Corporation, New York, N.Y.

[21] Appl. No.: 834,952

[22] Filed: Sep. 20, 1977

[30] Foreign Application Priority Data

Oct. 8, 1976 [NL] Netherlands ..... 7611135

[51] Int. Cl.[2] ..... H01J 61/24

[52] U.S. Cl. ..... 313/178; 313/176; 313/217

[58] Field of Search ..... 313/174, 176, 178

[56] References Cited

U.S. PATENT DOCUMENTS 3,983,440 9/1976 Scott et al. ..... 313/178 X

*Primary Examiner*—Rudolph V. Rolinec
*Assistant Examiner*—Darwin R. Hostetter
*Attorney, Agent, or Firm*—Frank R. Trifari; Robert S. Smith

[57] ABSTRACT

In high-pressure discharge lamps an electrode pin is provided with a closed cavity extending in the longitudinal direction and in which a hydrogen getter is present. The end of the electrode pin extending in the discharge vessel is formed by a metal part of a hydrogen-permeable metal which bounds the cavity.

This construction provides a solution for the contradictory requirements which have to be imposed upon the arrangement of a getter with a hydrogen-permeable envelope. The construction furthermore provides a hydrogen getter with both a high reactivity and a great capacity.

3 Claims, 6 Drawing Figures

HIGH-PRESSURE DISCHARGE LAMP

Figure 1:
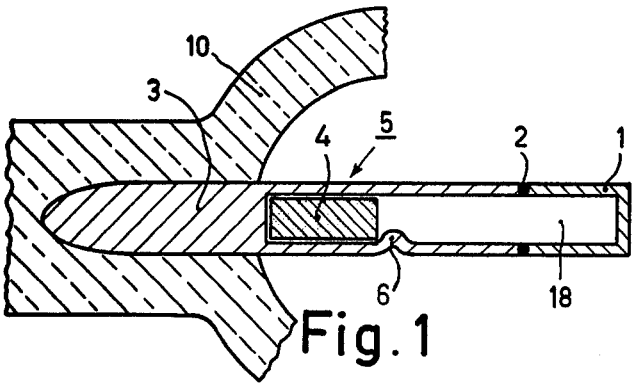

The invention relates to a high-pressure discharge lamp having a discharge vessel comprising a gas filling, electrodes with electrode pins which are sealed into the wall of the discharge vessel and a hydrogen getter in a metal envelope which is hydrogen permeable.

Such discharge lamps are known from German Offenlegungsschrift No. 2,452,044. In the known lamps the hydrogen getter is enclosed in a capsule of hydrogen-permeable metal so as to protect the getter from attack by the gas filling.

On the known lamps the welding seam between the bottom portion and the cover portion of the capsule which surrounds the getter is comparatively long so that great welding accuracy is required to prevent leakage.

The getter together with its envelope constitutes an extra component which has to be built into the discharge vessel as separate component.

Both in high-pressure mercury vapour lamps containing metal halide additions and in lamps without said additions the temperature of the getter during operation of the lamp proves to be particularly important. A lamp having a satisfactorily operating getter can consequently give unsatisfactory results when the operating position is changed, as generally at the same time a change in the getter temperature is brought about.

It is an object of the invention to provide discharge lamps in which the possibility of leakage in the envelope of the getter is minimized, the getter need not be assembled as a separate component in the lamp and the reliable operation of the getter is independent of the operating position of the lamp.

According to the invention, this object is achieved in lamps of the kind mentioned in the preamble in that the electrode pin of at least one electrode comprises a closed cavity extending in the longitudinal direction thereof, in which cavity the hydrogen getter is present adjacent to the wall of the discharge vessel and at least mainly within the discharge vessel and that the electrode pin at its end within the lamp discharge vessel consists of a metal part of a metal selected from the group formed by tantalum, niobium, alloys of tantalum and niobium and alloys of at least 5 atom.% of at least one of the said material with at least one of the metals tungsten and molybdenum, which metal part bounds the cavity in the electrode pin.

Tantalum and niobium, their alloys and alloys of Ta and/or Nb with tungsten and/or molybdenum, can both withstand very high temperatures and are hydrogen-permeable to a very considerable extent.

It has been found that for an optimum operation of a hydrogen getter surrounded by a hydrogen-permeable wall, contradictory requirements are to be imposed upon the position where the enveloped getter is located in the lamp.

In order to obtain a high gettering capacity, it is necessary for the getter to be arranged at a position in the discharge vessel where the temperature is as low as possible, although the rate at which small quantities of hydrogen are bound is larger at higher temperatures.

However, in high-pressure mercury vapour discharge lamps having a gas filling which contains metal halides, the getter must be at a temperature which is as high as possible for the benefit of the resistance of the enveloping metal to attack by halogen, since the equilibrium $Me + n\ Hal \rightleftarrows MeHal_n$ is strongly shifted to the left at high temperatures.

It has also been found that in high-pressure mercury vapour discharge lamps containing no halides an accommodation at high temperature for the metal envelope of the getter is desired. When the gas atmosphere contains small quantities of oxygen or nitrogen, they can form oxides and nitrides respectively with the metals of the getter envelope, which makes the getter envelope less hydrogen-permeable. When, however, the getter envelope is at a high temperature, oxygen and nitrogen, respectively, will diffuse inwardly through the wall of the getter envelope more rapidly and the high hydrogen permeability is regained.

In the lamps according to the invention a solution is provided for the contradictory requirements which are imposed upon the location of the getter in the lamp. Part of the getter envelope having a high hydrogen-permeability is at the end of an electrode pin which is located inside the discharge vessel and is therefore at very high temperature, the remaining part of the pin consisting, for example, of tungsten or molybdenum. The getter on the contrary is situated in the electrode pin near the wall of the discharge vessel and is therefore at a relatively low temperature. If in a preferred embodiment of the lamp according to the invention, the getter extends more towards the end of the electrode pin which is inside the discharge vessel, a larger temperature gradient over the getter is obtained during operation so that then the advantage of a getter at higher temperature and having a high reactivity is combined with that of a getter at a lower temperature and having a high gettering capacity.

Figure 4:
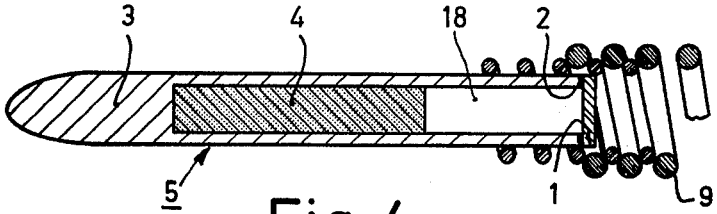

It is to be noted that FIG. 4 of the said Offenlegungsschrift shows an electrode in which on the surface of the electrode pin, at some distance from the electrode head, a hydrogen getter is accommodated on which a hydrogen-permeable metal layer is provided. Said accommodation does not satisfy the objects of the invention for the mere reason that the getter is exclusively at a temperature which is comparatively high for the getter and the envelope is at the same temperature which is comparatively low for the getter envelope.

Furthermore it is to be noted that a high pressure mercury vapour discharge lamp with halide additions is known from U.S. Pat. Specification No. 3,405,303, in which the electrode head has a cavity facing the discharge in which, for example, yttrium is present. During operation of the lamp the yttrium evaporates so that yttrium losses of the gas filling can be compensated for. It appears that in this known lamp the yttrium in the electrode head can have no gettering function. In addition, said metal is at too high a temperature to bind hydrogen.

The hydrogen getter, for example scandium or a hydrogen-binding material stated in the said Offenlegungsschrift, namely yttrium, lanthanum, a lanthanide or an alloy thereof, in lamps according to the invention is situated at the end of the cavity in the electrode pin facing the wall of the discharge vessel. A part of the getter during operation of the lamp is preferably at a temperature below 900° C. If the cavity in the pin extends to the point where the pin enters the wall of the discharge vessel or to the part of the pin situated in the wall of the discharge vessel, a getter temperature of 700° to 800° C can be realized locally. Due to the higher capacity of the getter at said lower temperatures, lamps in which the getter is at least partly at a temperature of 800° C or less are to be preferred. It is furthermore advantageous if getter material is also present at the end of the electrode pin extending further into the lamp vessel, at temperatures between 900° and 1000° C, more especially at temperatures between 900° and 1200° C, this due to the high reactivity of the getter materials at higher temperature.

The temperature across the getter during operation of the lamp preferably increases from at least 800° C near the end of the cavity in the electrode pin facing the wall of the discharge vessel up to 1000° C in a place more remote therefrom, and more preferably from at least 700° C up to 1200° C.

The getter material may be in the form, for example of a wire, a rod or a compressed moulding.

Figure 5:
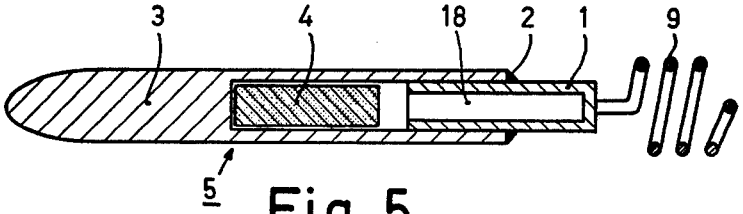

If desired, means may be present in the cavity in the electrode pin to prevent the getter from moving in the cavity. For that purpose, a rod or hollow cylinder, a coiled wire or a powder, for example of tungsten or molybdenum may serve which is provided between the getter and the end of the cavity remote from the wall of the discharge vessel. It is alternatively possible, however, for the cavity to locally have a smaller cross-section, for example, in that the electrode pin is intended. The getter may alternatively be accommodated so as to be clamped in the cavity, or the hydrogen-permeable metal part may fix the getter, for example, as is shown in FIG. 5 of the accompanying drawings referred to below.

The length of the electrode pin part in a lamp having a gas filling which can attack the hydrogen-permeable metal of the end of the electrode pin projecting inside the discharge vessel at lower temperatures, for example in a high-pressure halide lamp, which part is formed from hydrogen-permeable metal is preferably selected so that said metal has a temperature of more than 1500° C. Preferably, the hydrogen-permeable metal part only contacts the gas atmosphere in the lamp at the end face of the electrode pin. In high-pressure mercury vapour lamps without halide additions, parts of the electrode pin with a lower operating temperature may also be manufactured from hydrogen-permeable metal.

In contrast with the case in the getter of the known lamps, the welding seam which seals the housing of the getter in lamps according to the invention may be particularly short, for example equal to the circumference of the electrode pin.

In the lamps according to the invention, the hydrogen-permeable part of the electrode pin as a rule has at least locally a wall thickness of 0.1 to 1 mm.

The electrode pins may not be provided with electrode heads, for example, of helically wound wire.

Figure 6:
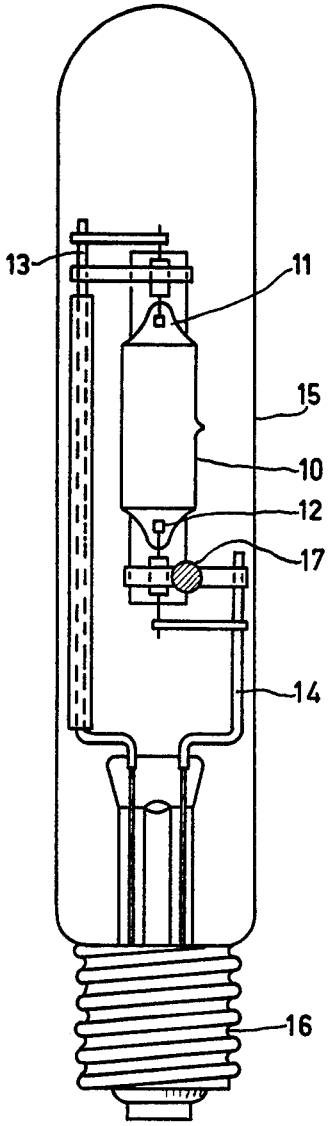

Some embodiments of the invention will now be described with reference to FIGS. 1 to 6 of the accompanying drawings, in which FIGS. 1 to 5 are longitudinal sectional views of electrode pins suitable for use in high-pressure discharge lamps, and FIG. 6 is a side elevation of a high-pressure discharge lamp according to the invention.

In FIGS. 1 to 5, a metal part 1 of hydrogen-permeable metal is welded at 2 to a pin part 3 which is made of, for example, tungsten or molybdenum and which comprises a cavity 18. The conical end of the pin part 3 is incorporated in the wall of a discharge vessel in a high-pressure discharge lamp. The place where the inner surface of the wall of the discharge vessel 10 joins the electrode pin in the finished lamp is denoted by the arrow 5. A hydrogen getter is denoted by 4.

Figure 2:
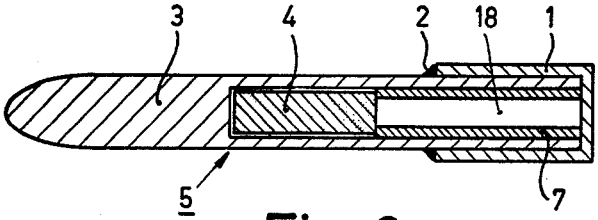
Figure 3:
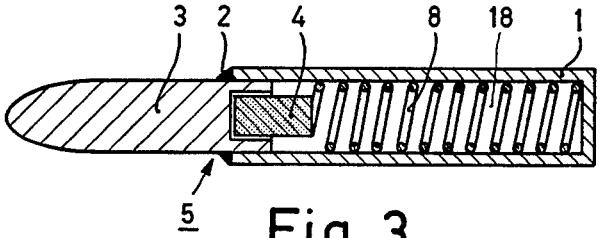

In the FIGS. 1 and 4, the weld between the two electrode pin parts 1 and 3 is a stud weld, in FIGS. 2 and 3 part 1 partly surrounds part 3, while in FIG. 5 part 1 is situated partly within part 3, which simplifies the assembly of the electrode.

In FIG. 1 the electrode pin has an indentation 6, while in FIG. 2 a hollow cylinder 7, for example of tungsten, is present in the electrode pin to locate the getter material 4.

In FIG. 3 a helically wound wire 8 is used for the same purpose. The electrode shown in this Figure in which the hydrogen-permeable part 1 continues far in the direction of the wall of the discharge vessel is particularly suitable for high-pressure mercury vapour discharge lamps.

In FIG. 4, the getter material 4 is present partly within the part of the electrode pin situated in the wall of the discharge vessel. In this Figure, only the top face of the electrode pin consists of hydrogen-permeable metal 1. In this embodiment the electrode has a helically wound tungsten wire 9 so that the discharge arc in this electrode does not extend from the top face of the electrode pin but extends from the helically wound wire 9.

In FIG. 5 the electrode pin also has a helically wound wire 9 from which during operation the discharge arc extends. The sleeve 1 limits the movement of the getter material 4.

FIG. 6 shows a finished 400 Watt high-pressure mercury vapour discharge lamp containing a metal halide addition. Two electrodes, 11 and 12, are located in a quartz glass discharge vessel 10, electrode 12 being constructed as shown in FIG. 4. The discharge vessel 10 is arranged between current supply conductors 13 and 14 in a glass outer envelope 15 which has a lamp cap 16. A getter 17 is provided in the outer envelope 15.

The electrode pins described above with reference to any of FIGS. 1, 2, 3 or 5 may be incorporated in lamps similar to that described with reference to FIG. 6.

What is claimed is

1. A high-pressure discharge lamp having a discharge vessel comprising a gas filling, electrodes with electrode pins which are sealed into the wall of the discharge vessel and a hydrogen getter in a metal envelope, which is hydrogen permeable, characterized in that the electrode pin of at least one electrode comprises a closed cavity extending in the longitudinal direction thereof in which cavity the hydrogen getter is present adjacent to the wall of the discharge vessel and at least mainly within the discharge vessel and that the electrode pin at its end within the lamp vessel consists of a metal part of a metal selected from the group formed by tantalum, niobium, alloys of tantalum and niobium and alloys of at least 5 atom % of at least one of the said materials with at least one of the metals tungsten and molybdenum, which metal part bounds the cavity in the electrode pin.

2. A high-pressure discharge lamp as claimed in claim 1, characterized in that during operation of the lamp the temperature across the getter increases at least from 800° C near the end of the cavity in the electrode pin facing the wall of the lamp vessel to 1000° C in a place more remote therefrom.

3. A high-pressure discharge lamp as claimed in claim 2, characterized in that the temperature across the getter increases from at least 700° C to 1200° C.

* * * * *

UNITED STATES PATENT AND TRADEMARK OFFICE

CERTIFICATE OF CORRECTION

PATENT NO. : 4,101,796
DATED : July 18, 1978
INVENTOR(S) : Gijsbert Kuus et al.

It is certified that error appears in the above-identified patent and that said Letters Patent are hereby corrected as shown below:

In the title page, the inventors' names should read

--Gijsbert Kuus; Peter Andreas Waltherus Tielemans--

Signed and Sealed this

*Thirteenth* Day of *January 1981*

[SEAL]

*Attest:*

SIDNEY A. DIAMOND

*Attesting Officer*

*Commissioner of Patents and Trademarks*